US010329842B2

(12) United States Patent
Russell

(10) Patent No.: US 10,329,842 B2
(45) Date of Patent: Jun. 25, 2019

(54) SYSTEM FOR GENERATING A HOLE USING PROJECTILES

(71) Applicant: HYPERSCIENCES, INC., Spokane, WA (US)

(72) Inventor: Mark C. Russell, Spokane, WA (US)

(73) Assignee: HYPERSCIENCES, INC., Spokane, WA (US)

( * ) Notice: Subject to any disclaimer, the term of this patent is extended or adjusted under 35 U.S.C. 154(b) by 0 days.

(21) Appl. No.: 15/348,796

(22) Filed: Nov. 10, 2016

(65) Prior Publication Data

US 2017/0138128 A1 May 18, 2017

Related U.S. Application Data

(60) Provisional application No. 62/255,161, filed on Nov. 13, 2015.

(51) Int. Cl.
*E21B 7/00* (2006.01)
*E21B 43/263* (2006.01)

(52) U.S. Cl.
CPC ..... *E21B 7/007* (2013.01); *E21B 43/263* (2013.01)

(58) Field of Classification Search
CPC ..... E21B 7/007; E21B 43/263; E21B 43/247; E21B 23/04
See application file for complete search history.

(56) References Cited

U.S. PATENT DOCUMENTS

| | | | |
|---|---|---|---|
| 2,544,573 | A | 3/1951 | Vincent |
| 2,621,732 | A | 12/1952 | Ahlgren |
| 2,913,959 | A | 11/1959 | Mohaupt |
| 3,075,463 | A | 1/1963 | Eilers et al. |

(Continued)

FOREIGN PATENT DOCUMENTS

| | | | |
|---|---|---|---|
| CN | 101017076 | A | 8/2007 |
| CN | 101099024 | A | 1/2008 |

(Continued)

OTHER PUBLICATIONS

Thomas, Shane, "Patent Cooperation Treaty International Search Report and Written Opinion dated Feb. 2, 2017", Patent Cooperation Treaty Application No. PCT/US16/61660, Patent Cooperation Treaty, Feb. 2, 2017.

(Continued)

*Primary Examiner* — D. Andrews
*Assistant Examiner* — Manuel C Portocarrero
(74) *Attorney, Agent, or Firm* — Lindauer Law, PLLC

(57) ABSTRACT

A wellbore or other type of hole in a geologic formation or other material, such as concrete or other manmade structures, may be formed by accelerating perforating charges containing detonable material through a tubular string. Movement of a fluid, such as drilling mud, may be used to transport perforating charges to a bottom hole assembly. In the bottom hole assembly, a propellant material may be used to accelerate the perforating charges, such as by using a ram acceleration mechanism. The perforating charges may be shaped to at least partially penetrate a surface of the hole. Detonation of the perforating charge may displace, stress, or fracture the geologic material. Movement of the fluid may remove displaced geologic material and detonated material from the perforating charge from the hole.

20 Claims, 9 Drawing Sheets

(56) References Cited

U.S. PATENT DOCUMENTS

| | | | |
|---|---|---|---|
| 3,185,224 | A | 5/1965 | Robinson, Jr. |
| 3,244,232 | A | 4/1966 | Myers |
| 3,253,511 | A | 5/1966 | Zwicky |
| 3,441,095 | A | 4/1969 | Youmans |
| 3,695,715 | A | 10/1972 | Godfrey |
| 3,863,723 | A | 2/1975 | Godfrey |
| 3,867,867 | A | 2/1975 | Duff |
| 4,030,557 | A | 6/1977 | Alvis et al. |
| 4,063,486 | A | 12/1977 | Ashley |
| 4,123,975 | A | 11/1978 | Mohaupt |
| 4,467,878 | A | 8/1984 | Ibsen |
| 4,582,147 | A | 4/1986 | Dardick |
| 4,638,712 | A | 1/1987 | Chawla et al. |
| 4,679,637 | A | 7/1987 | Cherrington et al. |
| 4,722,261 | A | 2/1988 | Titus |
| 4,791,850 | A | 12/1988 | Minovitch |
| 4,907,488 | A | 3/1990 | Seberger |
| 4,932,306 | A | 6/1990 | Rom |
| 4,982,647 | A | 1/1991 | Hertzberg et al. |
| 5,063,826 | A | 11/1991 | Bulman |
| 5,097,743 | A | 3/1992 | Hertzberg et al. |
| 5,098,163 | A | 3/1992 | Young, III |
| 5,421,237 | A | 6/1995 | Naumann |
| 5,487,405 | A | 1/1996 | Skoglund |
| 5,574,244 | A | 11/1996 | Powell et al. |
| 5,578,783 | A | 11/1996 | Brandeis |
| 5,768,940 | A | 6/1998 | Kawaguchi et al. |
| 5,833,003 | A | 11/1998 | Longbottom et al. |
| 5,996,709 | A | 12/1999 | Norris |
| 6,000,479 | A | 12/1999 | Ambs |
| 6,035,784 | A | 3/2000 | Watson |
| 6,457,417 | B1 | 10/2002 | Beal |
| 6,467,387 | B1 | 10/2002 | Espinosa et al. |
| 6,591,731 | B2 | 7/2003 | Goldstein |
| 7,069,862 | B2 | 7/2006 | Bassett |
| 7,681,352 | B2 | 3/2010 | Fu et al. |
| 7,775,148 | B1 | 8/2010 | McDermott |
| 7,942,481 | B2 | 5/2011 | Leppanen |
| 8,181,561 | B2 | 5/2012 | Riggs et al. |
| 8,302,584 | B1 | 11/2012 | Lu |
| 8,943,970 | B2 | 2/2015 | Greeley et al. |
| 9,103,618 | B2 | 8/2015 | Daniel et al. |
| 9,169,695 | B1 | 10/2015 | Calvert |
| 9,540,895 | B2 * | 1/2017 | Mackenzie ..... E21B 23/14 |
| 10,132,578 | B2 | 11/2018 | Knowlen et al. |
| 2002/0100361 | A1 | 8/2002 | Russell |
| 2005/0034896 | A1 | 2/2005 | Youan |
| 2007/0044963 | A1 | 3/2007 | MacDougall |
| 2007/0256826 | A1 | 11/2007 | Ceccarelli et al. |
| 2008/0205191 | A1 | 8/2008 | Coste et al. |
| 2009/0322185 | A1 | 12/2009 | Barnard et al. |
| 2010/0032206 | A1 | 2/2010 | Becker et al. |
| 2010/0133006 | A1 | 6/2010 | Shakra et al. |
| 2011/0114388 | A1 | 5/2011 | Lee et al. |
| 2011/0186377 | A1 | 8/2011 | Kline et al. |
| 2013/0032337 | A1 | 2/2013 | Rytlewski et al. |
| 2014/0158356 | A1 | 6/2014 | Andrzejak et al. |
| 2014/0260930 | A1 | 9/2014 | Russell |
| 2015/0021023 | A1 | 1/2015 | Roberts et al. |

FOREIGN PATENT DOCUMENTS

| | | | |
|---|---|---|---|
| CN | 102322216 | A | 1/2012 |
| CN | 102667047 | A | 9/2012 |
| CN | 102822442 | A | 12/2012 |
| CN | 202596572 | U | 12/2012 |
| DE | 2420035 | | 3/1976 |
| EP | 0663582 | A3 | 11/1995 |
| WO | 1999037878 | | 7/1999 |
| WO | 2014149173 | A1 | 9/2014 |
| WO | 2015030730 | | 3/2015 |

OTHER PUBLICATIONS

Becamel, Philippe, "Patent Cooperation Treaty International Preliminary Report on Patentabililty dated Sep. 15, 2015", Patent Cooperation Treaty Application PCT/US2014/012317, Patent Cooperation Treaty, Sep. 15, 2015.

Committee on Advanced Drilling Technologies, "Drilling and Excavation Technologies for the Future", National Research Council, ISBN: 0-309-57320-3, <<Retrieved from http://www.nap.edu/catalog/2349.html>>, 1994, 176 pages.

Copenheaver, Blaine R., "Patent Cooperation Treaty International Search Report and Written Opinion dated Aug. 10, 2015", Patent Cooperation Treaty Application No. PCT/US2015/030320, Patent Cooperation Treaty, Aug. 10, 2015.

Fang, et al., "Hypersonic wave drag reduction performance of cylinders with repetitive laser energy depositions", 3rd Int'l Photonics & OptoElectronics Meetings (POEM 2010), Journal of Physics: Conference Series 276 (2011) 012021, [retrieved on Oct. 20, 2015]. Retrieved from <<http://iopscience.iop.org/article/10.1088/1742-596/276/1/012021/pdf>> 8 pages.

Gold, et al., "Concrete Penetration by Eroding Projectiles Experiments and Analysis", Journal of Engineering Mechanics, v122, pp. 145-152 <<Retrieved from ascelibrary.org on Feb. 17, 2013>>, Feb. 1996, 145-152.

Gold, et al., "Constitutive Models for Concrete Penetration Analysis", Journal of Engineering Mechanics v122 <<Retrieved from ascelibrary.org on Feb. 17, 2013 >>, Mar. 1996, pp. 230-238.

Jingna, Xie, "First Office Action dated Jun. 2, 2016", CN Patent Application No. 201480016227.3, The Chinese Intellectual Property Office, Jun. 2, 2016.

Lundquist, Robert G., "Underground Tests of the Ream Method of Rock Fragmentation for High-Speed Tunneling", Rapid Excavation and Tunneling Conference Proceedings, Ch. 56, <<Retrieved from http://www.onemine.org/view/?d=689528D8459E7257609C73381053FBF203FD5CC5A9FC7839952A414670F0591638551, Mar. 13, 2013>>, Jan. 1974, pp. 825-840.

Semick, Joshua T., "Notice of Allowance dated May 25, 2016", U.S. Appl. No. 14/708,932, The United States Patent and Trademark Office, May 25, 2016.

Weber, Jonathan C., "Non-final Office Action dated Dec. 20, 2016", U.S. Appl. No. 15/292,011, The United States Patent and Trademark Office, Dec. 20, 2016.

Weber, Jonathan C., "Non-Final Office Action dated Jun. 1, 2015", U.S. Appl. No. 13/841/236, The United States Patent and Trademark Office, Jun. 1, 2015.

Weber, Jonathan C., "Notice of Allowance dated Jul. 14, 2016", U.S. Appl. No. 13/841,236, The United States Patent and Trademark Office, Jul. 14, 2016.

Young, Lee W., "Patent Cooperation Treaty International Search Report and Written Opinion dated Jan. 8, 2016", Patent Cooperation Treaty Application No. PCT/US2015/056947, Patent Cooperation Treaty, Jan. 8, 2016.

Young, Lee W., "Patent Cooperation Treaty International Search Report and Written Opinion dated Jul. 28, 2016", Patent Cooperation Treaty Application No. PCT/US2016/028704, Patent Cooperation Treaty, Jul. 28, 2016.

Young, Lee W., "Patent Cooperation Treaty International Search Report and Written Opinion dated May 16, 2014", Patent Cooperation Treaty Application No. PCT/US2014/012317, Patent Cooperation Treaty, May 16, 2014.

Semick, Joshua T., "Non-final Office Action dated Jul. 18, 2017", U.S. Appl. No. 15/246,414, The United States Patent and Trademark Office, Jul. 18, 2017.

Sayre, James G., "Non-Final Office Action dated Aug. 24, 2017", U.S. Appl. No. 14/919,657, The United States Patent and Trademark Office, Aug. 24, 2017.

Weber, Jonathan C., "Final Office Action dated Jun. 15, 2017", U.S. Appl. No. 15/292,011, The United States Patent and Trademark Office, Jun. 15, 2017.

Kasten, Klaus, "European Search Report dated Jan. 23, 2017", European Application No. 14770528.9, European Patent Office, Jan. 23, 2017.

(56) References Cited

OTHER PUBLICATIONS

Young, Lee W., "Patent Cooperation Treaty International Search Report and Written Opinion dated Jan. 19, 2017", Patent Cooperation Treaty Application No. PCT/US16/60129, Patent Cooperation Treaty, Jan. 19, 2017.
Bogdanoff, David W., "New Tube End Closure System for the Ram Accelerator," Journal of Propulsion and Power., vol. 10, No. 4, Jul. 1-Aug. 1994, pp. 518-521.
Hansen, Viggo, "Ram Accelerator Animation", YouTube, Science & Technology, Uploaded on May 2, 2011. Retrieved from the Internet: https://www.youtube.com/watch?v=iFQfOKVi98l.
Van Berlo, Andre, "European Search Report dated Sep. 7, 2017", European Patent Application No. 15791990.3, European Patent Office, Sep. 7, 2017.
Wittmann-Regis, Agnes, "PCT International Preliminary Report on Patentability dated May 24, 2018", Patent Cooperation Treaty Application No. PCT/US16/60129, Patent Cooperation Treaty, May 24, 2018.
Runyan, Ronald R., "Final Office Action dated Jan. 28, 2019", U.S. Appl. No. 15/135,452, The United States Patent and Trademark Office, Jan. 28, 2019.

* cited by examiner

SYSTEM FOR GENERATING A HOLE USING PROJECTILES

CROSS-REFERENCE TO RELATED APPLICATION

This patent application claims priority to the U.S. provisional application for patent, having application Ser. No. 62/255,161, filed on Nov. 13, 2015, entitled "Down-Hole Hyperdrill". Application 62/255,161 is incorporated by reference herein in its entirety.

INCORPORATION BY REFERENCE

In addition to Application 62/255,161, which is incorporated by reference in its entirety above, the following are incorporated by reference for all that they contain:

U.S. provisional patent application 62/253,228, filed on Nov. 10, 2015, entitled "Pressurized Ram Accelerator System".

U.S. patent application Ser. No. 15/340,753, filed on Nov. 1, 2016, entitled "Projectile Drilling System".

U.S. patent application Ser. No. 13/841,236, filed on Mar. 15, 2013, entitled "Ram Accelerator System".

U.S. patent application Ser. No. 15/292,011, filed on Oct. 12, 2016, entitled "Ram Accelerator System".

U.S. provisional patent application 61/992,830, filed on May 13, 2014, entitled "Ram Accelerator System with Endcap".

U.S. patent application Ser. No. 14/708,932, now U.S. Pat. No. 9,458,670, filed on May 11, 2015, entitled "Ram Accelerator System with Endcap".

U.S. patent application Ser. No. 15/246,414, filed on Aug. 24, 2016, entitled "Ram Accelerator System with Endcap".

U.S. provisional patent application 62/067,923, filed on Oct. 23, 2014, entitled "Ram Accelerator System with Rail Tube".

U.S. patent application Ser. No. 14/919,657, filed on Oct. 21, 2015, entitled "Ram Accelerator System with Rail Tube".

U.S. provisional patent application 62/150,836, filed on Apr. 21, 2015, entitled "Ram Accelerator System with Baffles".

U.S. patent application Ser. No. 15/135,452, filed on Apr. 21, 2016, entitled "Ram Accelerator System with Baffles".

U.S. provisional patent application 393,631, filed on Sep. 12, 2016, entitled "Augmented Drilling System Using Ram Accelerator Assembly".

BACKGROUND

One concern relating to use of rotary, impact, or percussive drilling methods when forming a wellbore is well control. A weighted or pressurized drilling fluid, such as drilling mud, may be used to provide pressure control against pressures encountered in a geological formation. Drilling mud is typically pumped toward the bottom of a wellbore using a single tubular string, then returned to the surface via the outer annulus between the tubular string and the walls of the wellbore.

BRIEF DESCRIPTION OF DRAWINGS

Certain implementations and embodiments will now be described more fully below with reference to the accompanying figures, in which various aspects are shown. However, various aspects may be implemented in many different forms and should not be construed as limited to the implementations set forth herein. The figures are not necessarily to scale, and the relative proportions of the indicated objects may have been modified for ease of illustration and not by way of limitation. Like numbers refer to like elements throughout.

Figure 1:
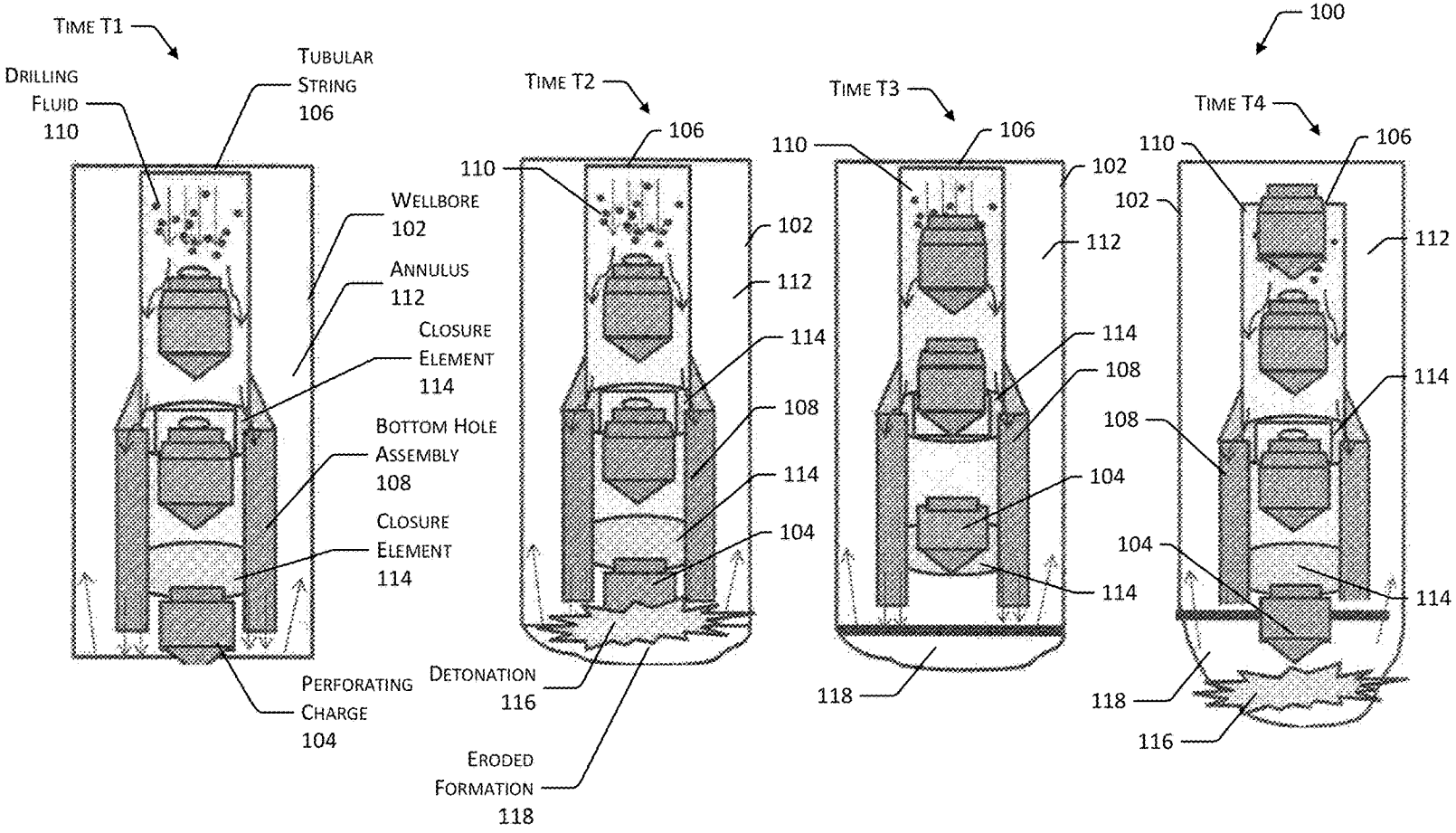
FIG. 1 is a series of diagrams illustrating a process for extending a wellbore using perforating charges.

While implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

Some conventional drilling techniques for forming a wellbore include rotary, impact, or percussive drilling methods. Resources, such as water, gas, oil, and so forth, may be present in a geologic formation, such as rock. The resources in the geologic formation may be under pressure. To provide pressure control against the pressures within the formation, a weighted or pressurized drilling fluid, such as drilling mud, may be pumped into the wellbore. Drilling muds may be water-based, carbon dioxide-based, petroleum-based, oil-based, or may include other liquids, gasses, or fluids. Typically, a wellbore is formed using a single tubular string, through which drilling mud may be pumped to the bottom of the hole, where drilling operations occur. The drilling mud then flows from the bottom of the hole toward the surface through the outer annulus surrounding the tubular string. In addition to resisting the formation pressures within the wellbore, drilling fluids may also stabilize the wellbore, reduce friction during the drilling operation, and remove cuttings or other debris from the wellbore.

This disclosure relates to techniques for drilling, in a downhole environment, using explosive perforating charges in conjunction with a tubular string. The perforating charges may include detonable (e.g., explosive) material. In some cases, the tubular string may include elements associated with a drilling system, which may be operated in series or in parallel with the use of the perforating charges. For example, an existing tubular string used during conventional drilling techniques may be equipped with a specialized drill bit that may be used in conjunction with perforating charges. An at-surface or above-ground loading mechanism and pump mechanism may be used to move perforating charges, which may be more dense than the drilling mud, through the tubular string. The fluid motion of the drilling mud or other materials and the weight of the charges may facilitate movement of the charges through the tubular string, while the pressure of the drilling mud and the weight of the charges may maintain pressure control of the wellbore.

A charge unit, which in some implementations may be formed from metallic and explosive components, may be flowed through a portion of the tubular string to impact the bottom of the hole, eroding both a portion of the geologic formation and the charge unit itself. In some cases, the charge unit may be accelerated to a high speed, such as through use of a mass and shock driving mechanism. In other cases, the charge unit may be moved through the tubular string using the flow of drilling fluid or other materials. The particles resulting from the interaction between the charge unit and the geologic material may be returned to the surface using the flow of the drilling mud, in the manner associated with typical transport of cuttings. In some implementations, the perforating charges may be accelerated using chemical energy. However, in other implementations, perforating charges may be accelerated using components of a hypersonic-augmented drilling system, impact (e.g., using pneumatic or mechanical force), or rotational energy. In some implementations, a charge unit may include multiple parts which may be separable or integral. For example, a charge unit may include a penetrator section configured to penetrate or erode the geological material. In one implementation, the penetrator section may include a shape similar to that of a drill bit. The charge unit may also include one or more separation stages that create barriers between different portions thereof. Additionally, a charge unit may include one or more propellant generating materials. Propellant generating materials may include a solid, liquid, or gas that under specific conditions (e.g., mechanical, electrical, or pressure-based conditions) may provide a force to the charge unit, such as a mass-based force, a pressure, a shock wave, and so forth. For example, actuation of a propellant generating material may cause generation of gas or another fluid, which may accelerate the perforating charge to penetrate through geologic material. In some implementations, generated propellant materials may also act as diluents.

In one implementation, the tubular string may be provided with a heavy, steel bottom hole assembly, such as a bottom hole assembly having a length of 50 feet. Perforating charges may be provided with a shape that facilitates transport and embedding of the charges, such as the shape of a chip or puck. For example, the charges may be shaped in a manner that facilitates nesting or stacking of the charges on top of one another, or transporting through the tubular string, one after the other. Individual perforating charges, or stacks thereof, may be released through an opening, such as a port accessible using a ball valve or other closure element, to position the charges in the drilling mud, between a surface of the wellbore and the bottom hole assembly. In some cases, the perforating charges may be passed through an opening without use of a closure element. The charges may then be detonated, which in some implementations, may create a Monroe jet or similar movement of explosive gas, shock waves, and particles of metal or other materials that may penetrate and erode the geologic formation and the charge itself. The perforating charges may be configured to direct the energy from detonation thereof as a shock wave, causing very little bulk gas movement. In some cases, materials generated through combustion or erosion of the charge or geologic material may be condensed or suspended within the drilling mud. The drilling mud may provide a barrier between the formation and the ball valve or other closure or separator mechanism in the bottom hole assembly through which the charges may be accelerated. In some implementations, the closure mechanism may include a floating ball or endcap. In other implementations, the pressure of the drilling mud may function to restrict backflow or ingress of material in place of or in addition to an endcap or other closure mechanism. Additionally, the drilling mud may function as a recoil mechanism against which the force from the perforating charge may push against to direct the charge toward the geologic material at the bottom of the hole.

The perforating charges may be used continuously, or semi-continuously, to bore through geologic material using the perforating charges, in the manner of a percussive perforation gun, that may be operated nearly entirely below the surface (e.g., in a downhole environment near the working face of a wellbore). Use of a single column in conjunction with fluid and charge units may facilitate well pressure control and limit the energy losses associated with long transits through tubular strings. In some implementations, in situ propellant materials may be used to accelerate the perforating charges. Propellant materials may include pressurized or combustible gasses, diesel, or similar components that may be used to impart a force to a perforating charge. For example, structures containing propellant materials may be pumped into a tubular string. As another example, propellant materials, such as gasses, may be entrained within the drilling mud, which may enable the materials to be transported toward the bottom of the hole without use of additional fluid connections. Propellant materials may be encapsulated in small pellets or dissolved or suspended into the drilling mud. In some implementations, the drilling mud may also contain one or more of fuel or oxidizer for use accelerating perforating charges, such as through use of a portion of the tubular string or bottom hole assembly as a ram accelerator or gas gun. Components entrained or suspended in the drilling mud may be separated from the drilling mud using a downhole mechanism. In some cases, the acceleration or impact of a perforating charge may initiate a mechanism for the release and capture of fluids or gasses used for the acceleration process. As yet another example, material within the charge unit, itself, may include a propellant material or a material that can be used to generate propellant material in the downhole environment. Use of in situ propellant materials may enable movement of surface components, such as the rotation of a drilling rod that provides energy to a downhole assembly, to be converted into chemical energy, which may then be used to provide energy to the perforating charges by providing linear velocity thereto.

In some implementations, radio frequency identification (RFID) chips, microchips, or similar communication components, materials, or devices may be suspended within the drilling fluid. The detectable materials may be used to communicate, via communication signals, with components of the downhole assembly, such as downhole logging equipment. Communication between devices, such as chips, within the drilling fluid may be used to provide data to computing devices at the surface or to communicate with downhole components. Such devices may also receive data from surface devices and transport the data to one or more downhole components.

FIG. 1 is a series of diagrams 100 illustrating a process for extending a wellbore 102 using perforating charges 104. The depicted diagrams 100 illustrate the process at a first time T1, a second time T2 subsequent to the first time T1, a third time T3 subsequent to the second time T2, and a fourth time T4 subsequent to the third time T3. A tubular string 106 within the wellbore 102 may have a bottom hole assembly 108 engaged to a lower end thereof. During operations, drilling fluid 110, such as drilling mud or other materials, may be circulated within the wellbore 102, such as by flowing the drilling fluid 110 from the surface toward the bottom of the wellbore 102 through the tubular string 106. The drilling fluid 110 may then return to the surface by flowing upward from the bottom of the wellbore 102 through an annulus 112 between the walls of the wellbore 102 and the outer surface of the tubular string 106. In some implementations, the drilling fluid 110 may flow through ports or fluid pathways located external to the inner bore of the bottom hole assembly 108, while the inner bore of the bottom hole assembly 108 may be used for the passage of perforating charges 104. For example, the bottom hole assembly 108 may include one or more closure elements 114, such as ball valves, which may be opened and closed to control the times at which single perforating charges 104 or groups of perforating charges 104 may be projected toward the bottom of the wellbore 102. Continuing the example, FIG. 1 depicts the bottom hole assembly 108 including two closure elements 114 proximate to the upper and lower ends of the inner bore of the bottom hole assembly 108, respectively.

As illustrated at the second time T2, the flow of drilling fluid 110 or other materials, such as propellant materials or other substances entrained in the drilling fluid 110, may urge at least one perforating charge 104 into the inner bore of the bottom hole assembly 108. For example, a closure element 114 may be opened to permit passage of the perforating charge 104 into the bottom hole assembly 108. Within the bottom hole assembly 108, the perforating charge 104 may be accelerated toward the bottom of the wellbore 102, such as through actuation of one or more propellant materials. In some implementations, a closure element 114 at the lower end of the bottom hole assembly 108 may be opened to permit passage of the perforating charge 104. The perforating charge 104 may at least partially penetrate, erode, or otherwise interact with geologic material at the bottom of the wellbore 102, and detonation 116 of the perforating charge 104 may further erode or displace geologic material, creating a region of eroded formation 118 at the bottom of the wellbore 102. Creation of the region of eroded formation 118 may extend at least one dimension of the wellbore 102, such as by increasing the length (e.g., depth) thereof.

The process illustrated at the first time T1 and second time T2 may be repeated using successive perforating charges 104. For example, at the third time T3, a subsequent perforating charge 104 may be urged into the bottom hole assembly 108, such as by the flow of the drilling fluid 110. At the fourth time T4, the perforating charge 104 may be accelerated to contact the bottom of the region of eroded formation 118, where a subsequent detonation 116 may further erode or displace geologic material from the wellbore 102.

In some implementations, use of perforating charges 104 to generate a wellbore 102 may eliminate the need for a separate circulating tube, which may increase the circulating area for drilling fluid 110 and other materials in the annulus 112, improving the removal of cuttings. For example, in one implementation, a generated wellbore 102 may have a diameter that is 2.75 times as large as that of the tubular string 106 used to provide the perforating charges 104 to the bottom of the wellbore 102. Use of a single tubular string 106 and movement of drilling fluid 110 to provide components into and from the wellbore 102 may improve well pressure control, efficiency, depth, lateral reach, and steering capability when compared to conventional drilling techniques. Additionally, use of the tubular string 106 and drilling fluid 110 may eliminate the need for separate lines or other conduits for providing materials to or removing materials from the wellbore 102.

Figure 2:
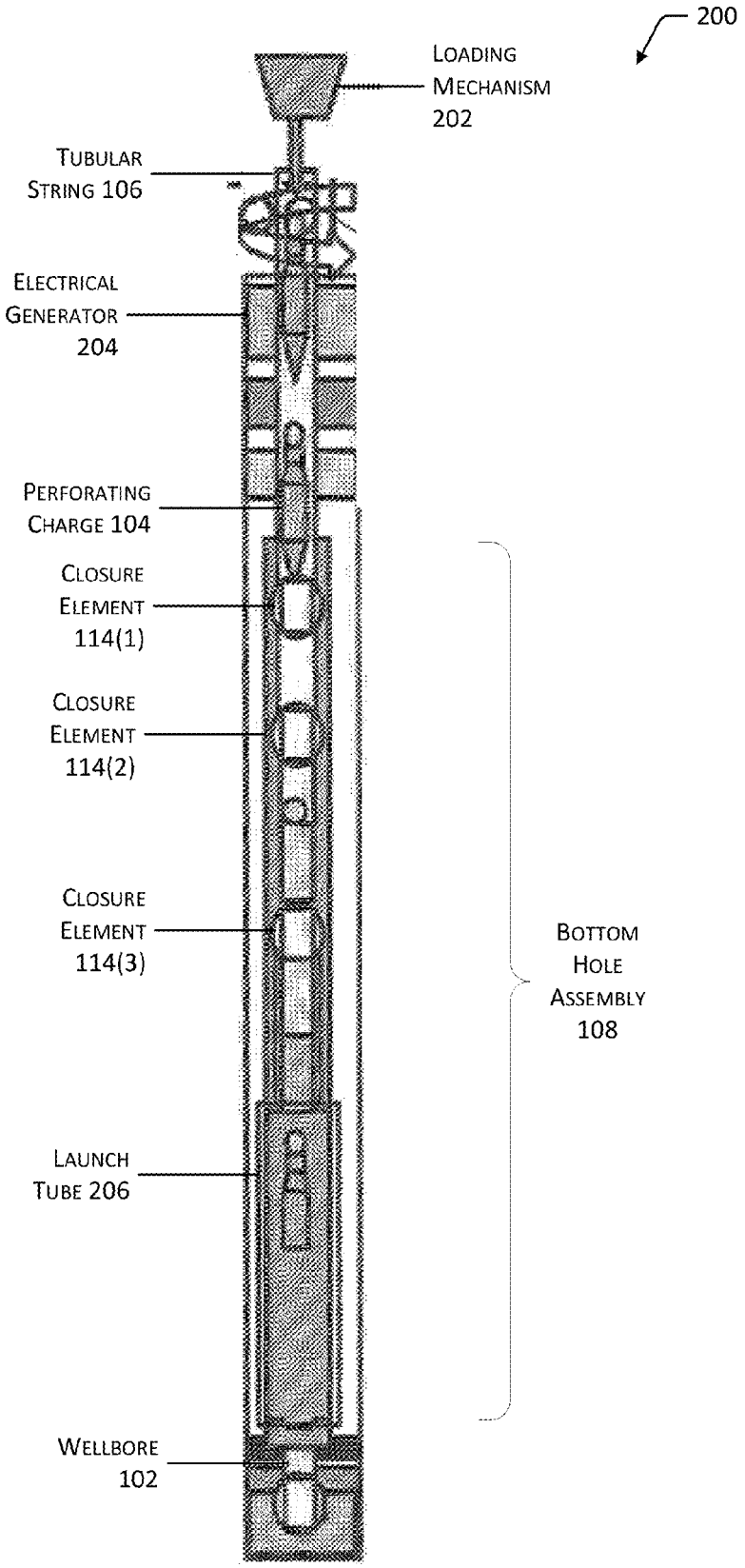
FIG. 2 illustrates an implementation of a system for forming a wellbore using perforating charges.

FIG. 2 illustrates a system 200 for forming a wellbore 102 using perforating charges 104. A loading mechanism 202 may be located at or above the surface, such as in association with a top drive engaged with the tubular string 106. The loading mechanism 202 may be engaged with a source of perforating charges 104 and may orient and pump the perforating charges 104 into the tubular string 106. For example, a loading mechanism 202 may automatically move perforating charges 104 from a rig floor into the tubular string 106. Drilling fluid 110 may move the perforating charges 104 through the tubular string 106. In some implementations, at least a portion of the drilling fluid 110 may flow around the perforating charges 104 to exit the lower end of the tubular string 106 and flow upward through the annulus 112. The movement of the perforating charges 104, by the drilling fluid 110, into a rotating portion of the tubular string 106 may actuate an electrical generator 204. In some implementations, the electrical generator 204 may be configured to engage and disengage from the wall of the wellbore 102. Torque applied to the electrical generator 204 by rotation of the tubular string 106 relative to the wall of the wellbore 102 may generate power. Power from the electrical generator 204 may be provided to portions of the bottom hole assembly 108 or other components used in association with generation of the wellbore 102, such as measurement or logging components, vacuum generating components, and so forth. In some implementations, the electrical generator 204 may be used to power a laser or other element that may be used to remove geologic material from the bottom of the wellbore 102.

The bottom hole assembly 108 may be engaged with the lower end of the tubular string 106. The bottom hole assembly 108 may include a launch tube 206 through which perforating charges 104 may be passed, and one or more closure elements 114, such as ball valves, that separate particular portions of the bottom hole assembly 108 from other portions. As described with regard to FIG. 1, drilling fluid 110 may be diverted away from the inner bore of the bottom hole assembly 108, while perforating charges 104 pass therethrough. In some implementations, perforating charges 104 may carry one or more of diluent, vacuum generating materials, fuel, oxidizer, gas or liquid-generating components, or additional gasses or liquids. The closure elements 114 may be sequentially operated to permit a single perforating charge 104 to pass through successive sections of the bottom hole assembly 108. For example, a first closure element 114(1) may be opened to permit entry of a perforating charge 104 into an upper portion of a launch tube 206. The first closure element 114(1) may be closed and a second closure element 114(2) opened to permit passage of the perforating charge 104 to a second portion of the launch tube 206. The second closure element 114(2) may then be closed and a third closure element 114(3) opened to permit passage of the perforating charge 104 to a lower portion of the bottom hole assembly 108. Operation of the closure elements 114 may enable queuing and sequencing of perforating charges 104 for successive acceleration toward the bottom of the wellbore 102.

In some implementations, the lower portion of the bottom hole assembly 108 may include a ram accelerator for accelerating the perforating charges 104 toward the bottom of the wellbore 102. The ram accelerator may include internal baffles or rails, dampers for affecting the movement of the perforating charges 104, and may include single or multiple stages. In some cases, the drilling fluid 110 or other substances proximate to the lower end of the bottom hole assembly 108 may prevent ingress of materials into the bottom hole assembly 108 from the lower end thereof. For example, the ram accelerator may be pressurized to a pressure equal to or greater than that of the wellbore 102 to provide well control. In other implementations, the bottom hole assembly 108 may include or be engaged with measurement while drilling equipment, a rotatable reamer or drill bit, such as a polycrystalline diamond compact or tri cone drill bit, or other equipment.

Figure 3:
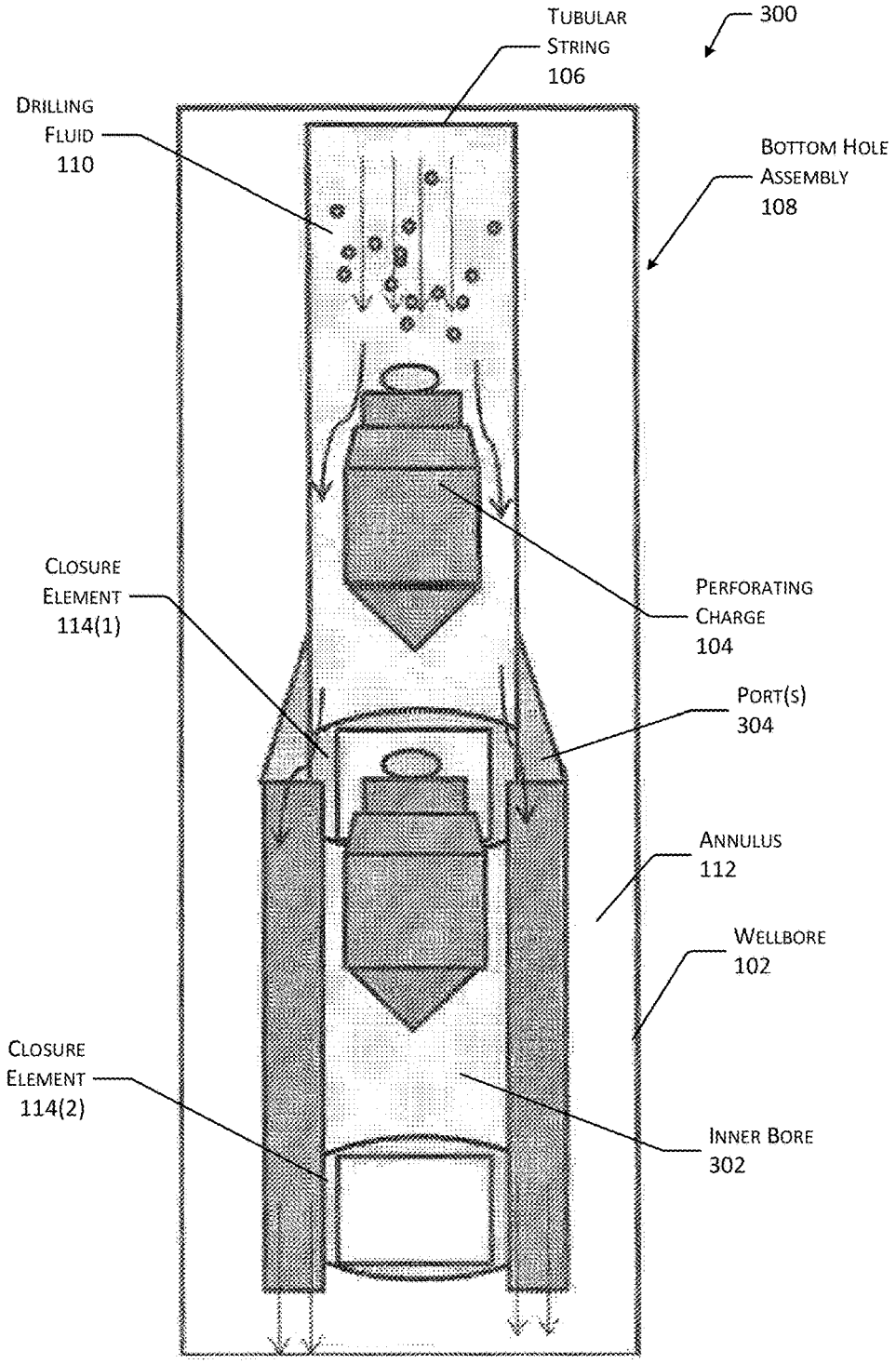
FIG. 3 is a diagram illustrating an implementation of a bottom hole assembly.

FIG. 3 is a diagram 300 illustrating an implementation of a bottom hole assembly 108. As described with regard to FIGS. 1 and 2, the bottom hole assembly 108 may be engaged with a tubular string 106 extending between the bottom of a wellbore 102 and the surface. The bottom hole assembly 108 may be configured to move perforating charges 104 received from the tubular string 106 toward the bottom of the wellbore 102. For example, FIG. 3 depicts the bottom hole assembly 108 including a first closure element 114(1) positioned above a second closure element 114(2), which is proximate to the lower end of the bottom hole assembly 108. In some implementations, the closure elements 114 may include ball valves. As drilling fluid 110 pushes perforating charges 104 through the tubular string 106 into the bottom hole assembly 108, the first closure element 114(1) may be opened to permit a single perforating charge 104 or group of perforating charges 104 to enter the inner bore 302 of the bottom hole assembly 108. After entry of the perforating charge 104 into the inner bore 302, the first closure element 114(1) may be closed to isolate the perforating charge 114(1) and inner bore 302 from the tubular string 106. At least a portion of the drilling fluid 110 may be diverted through one or more ports 304 external to the inner bore 302, to enable the drilling fluid 110 to exit the lower end of the bottom hole assembly 108 for circulation to the surface, which in some implementations, may facilitate evacuation or preparation of the inner bore 302 for acceleration of the perforating charge 104. For example, one or more propellant materials may be entrained in the drilling fluid 110, associated with the body of the perforating charge 104, or separately provided to the bottom hole assembly 108. The propellant material(s) may be actuated within the inner bore 302 to accelerate the perforating charge 104 toward the lower end of the bottom hole assembly 108. In other implementations, the first closure element 114(1) may be omitted, and the inner bore 302 of the bottom hole assembly 108 may be filled with drilling fluid 110. In some implementations, the drilling fluid 110 may include propellant material, water or other fluids for electrolysis, fuel, oxidizer, inert gas, and so forth. The second closure element 114(2) may be opened to permit the accelerated perforating charge 104 to exit the lower end of the bottom hole assembly 108 and impact the bottom of the wellbore 102. In some implementations, the lower portion of the bottom hole assembly 108 may include one or more mechanisms to align, capture, or support the perforating charges 104 that are transported into the inner bore 302.

Figure 4:
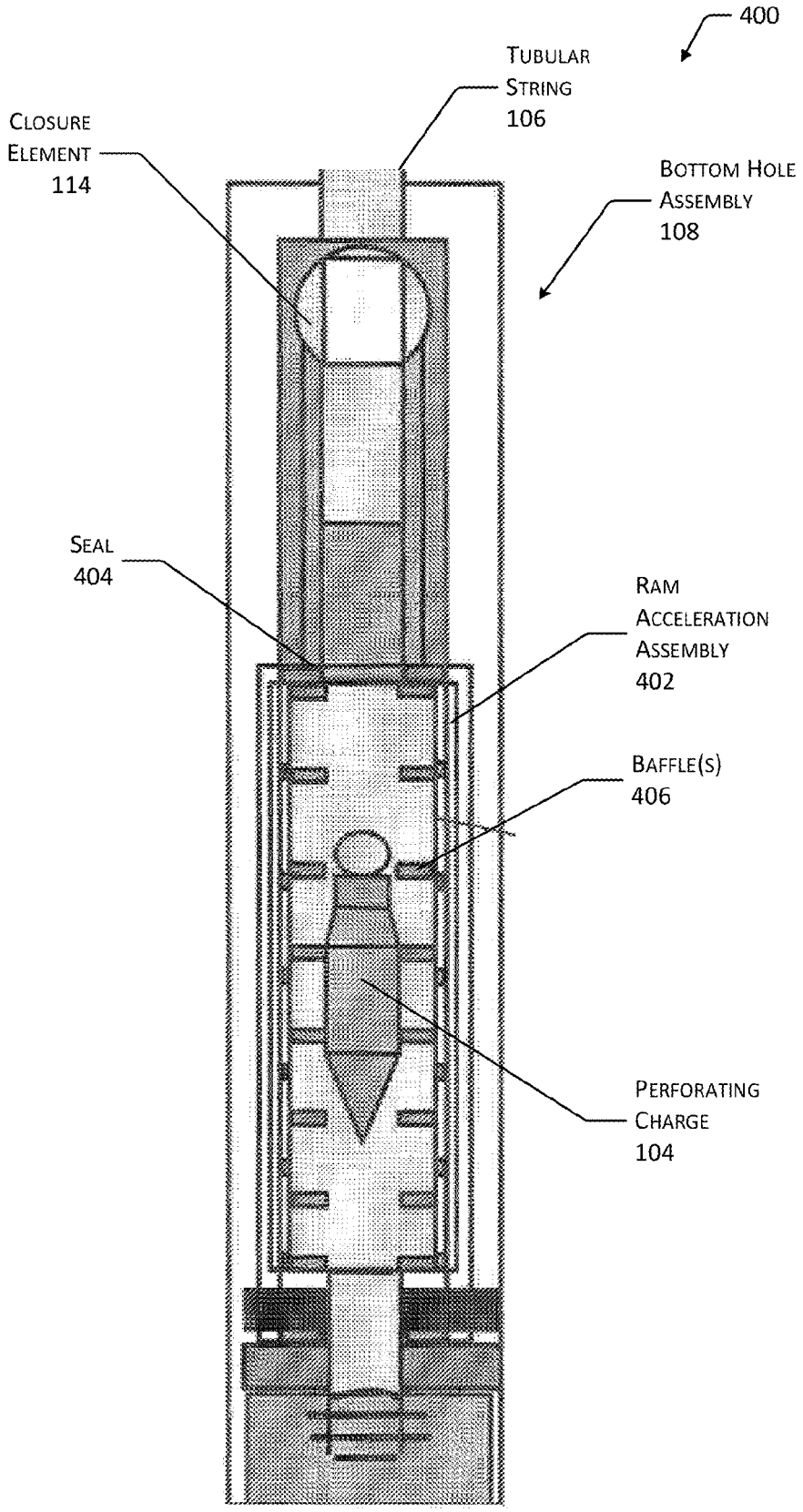
FIG. 4 is a diagram illustrating an implementation of a bottom hole assembly including a ram acceleration assembly for accelerating perforating charges into a wellbore.

FIG. 4 is a diagram 400 illustrating an implementation of a bottom hole assembly 108 including a ram acceleration assembly 402 for accelerating perforating charges 104 into a wellbore 102. As described with regard to FIGS. 1-3, perforating charges 104 may enter the inner bore 302 of the bottom hole assembly 108 via movement of drilling fluid 110, as a closure element 114 is opened to enable passage of the perforating charge 104. A perforating charge 104 may pass through a seal 404 between an upper portion of the bottom hole assembly 108 and the ram acceleration assembly 402. In some implementations, the seal 404 may include one or more cup-type seals 404. In other implementations, the ram acceleration assembly 402 may include one or more internal baffles 406, such as annular baffles 406. In still other implementations, the ram acceleration assembly 402 may include internal rails. One or more of the seal 404 or the baffle(s) 406 may capture or separate gas or other propellant materials contained in the drilling fluid 110 that may be used to accelerate the perforating charge 104 through the ram acceleration assembly 402. In other implementations, propellant material, such as a gas generating or fluid carrying material, may be included in the body of the perforating charge 104 or within the bottom hole assembly 108. Passage of the perforating charge 104 through each region of the ram acceleration assembly 402 defined by the baffles 406 may accelerate the perforating charge 104 through the bottom hole assembly 108 toward the bottom of the wellbore 102. In some implementations, the bottom hole assembly 108 may be constructed from stiff or heavy materials, such as steel, and may be of a significant size, such as 50 feet, to resist movement of the bottom hole assembly 108 that may be caused by detonation 116 of the perforating charge 104. The stiff nature of the bottom hole assembly 108 may facilitate direction of energy from the detonation 116 toward the geologic material at the bottom of the wellbore 102.

Figure 5:
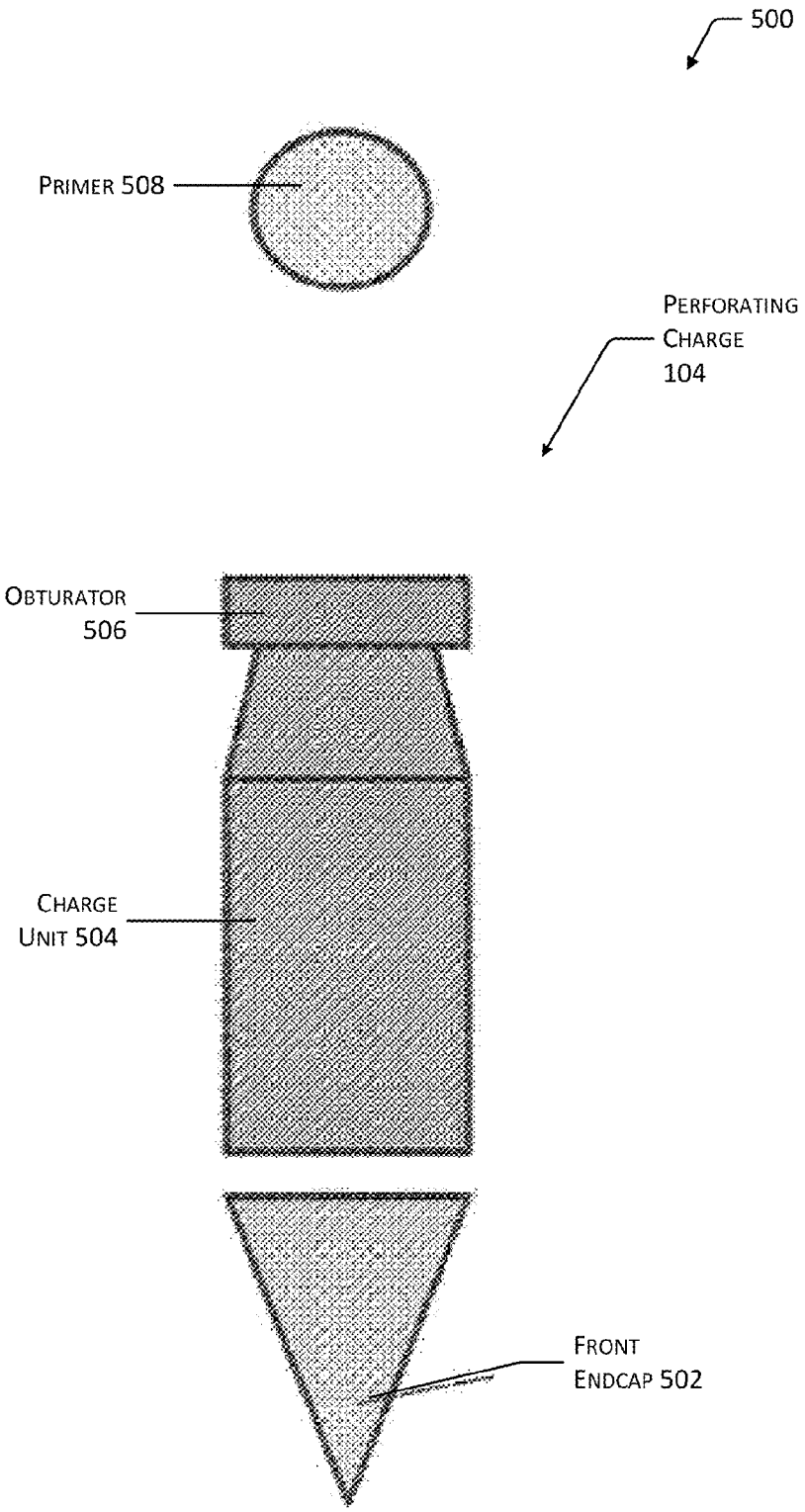
FIG. 5 is a diagram illustrating an implementation of a perforating charge.

FIG. 5 is a diagram 500 illustrating an implementation of a perforating charge 104. The perforating charge 104 may include a front endcap 502 located at a front end thereof. The front endcap 502 may have a triangular, conical, pyramid, wedge, chisel, or drill-bit shape configured to penetrate at least partially into geologic material of the formation upon impact between the perforating charge 104 and the formation. In some implementations, the front endcap 502 may be formed from one or more metallic materials. A charge unit 504 that includes one or more combustible materials, explosive materials, pressure-generating materials, or other materials that may be detonated or otherwise used to impart a force to the geologic material may be positioned behind the front endcap 502. An obturator 506 may be positioned behind the charge unit 504. The obturator 506 may include a plate or disc shape configured to receive a force applied by the drilling fluid 110, one or more propellant materials, and so forth, to accelerate the perforating charge 104 toward the geologic material. For example, force applied to the obturator 506 by one or more propellant materials may accelerate the perforating charge 104 through a ram acceleration assembly 402. In some implementations, the perforating charge 104 may include a primer 508 positioned behind the obturator 506. The primer 508 may function as a propellant material, catalyst, reactant, fuel, oxidizer, and so forth, to cause acceleration of the perforating charge 104. In other implementations, other portions of the body of the perforating charge 104 may include one or more propellant materials, fuels, oxidizers, and so forth. In still other implementations, drilling fluid 110 may provide at least a portion of the propellant material, fuel, oxidizer, and so forth to the perforating charge 104.

Figure 6:
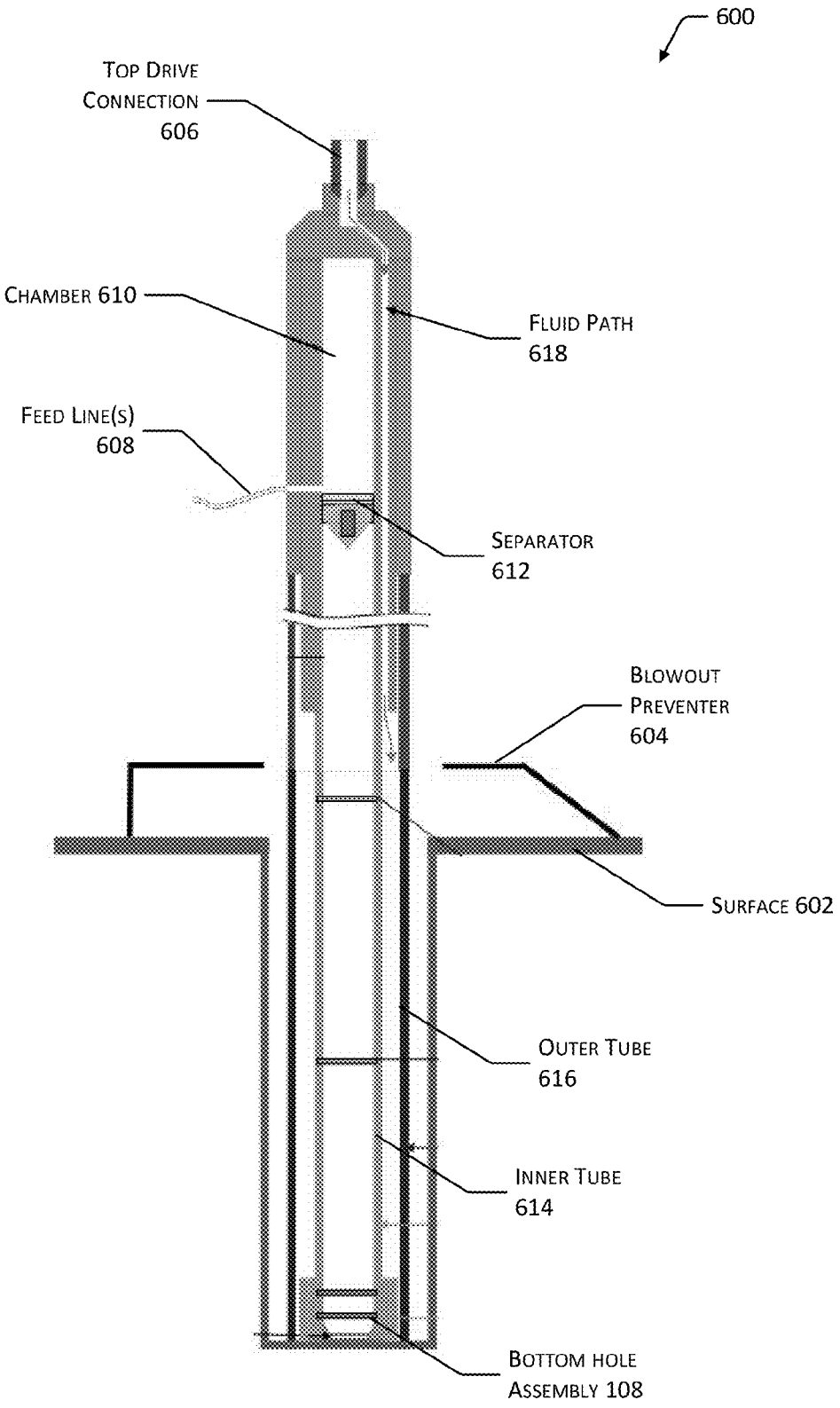
FIG. 6 illustrates an implementation of a system for providing components to a bottom hole assembly.

FIG. 6 illustrates one implementation of a system 600 for providing components to a bottom hole assembly 108. The system 600 may include portions positioned above the surface 602 as well as portions positioned below the surface 602 within a wellbore 102. In some implementations, the surface 602 may include a rig floor. For example, one or more blowout preventers 604 or other components may be positioned at the surface 602 near the upper end of the wellbore 102. A top drive connection 606 may engage an upper end of the system 600 to a top drive or other source of motive force. One or more feed lines 608 may be used to provide propellant materials, gas, fluid, or other sources of force into a chamber 610, which may impart a force to perforating charges 104 or other materials to propel the materials toward the bottom hole assembly 108. In some implementations, a separator 612 may separate the chamber 610 from other portions of the system 600. For example, the system 600 may include an inner tube 614 positioned within an outer tube 616. A fluid path 618 extending external to the inner tube 614 may direct fluid from a fluid source toward the bottom hole assembly 108.

Figure 7:
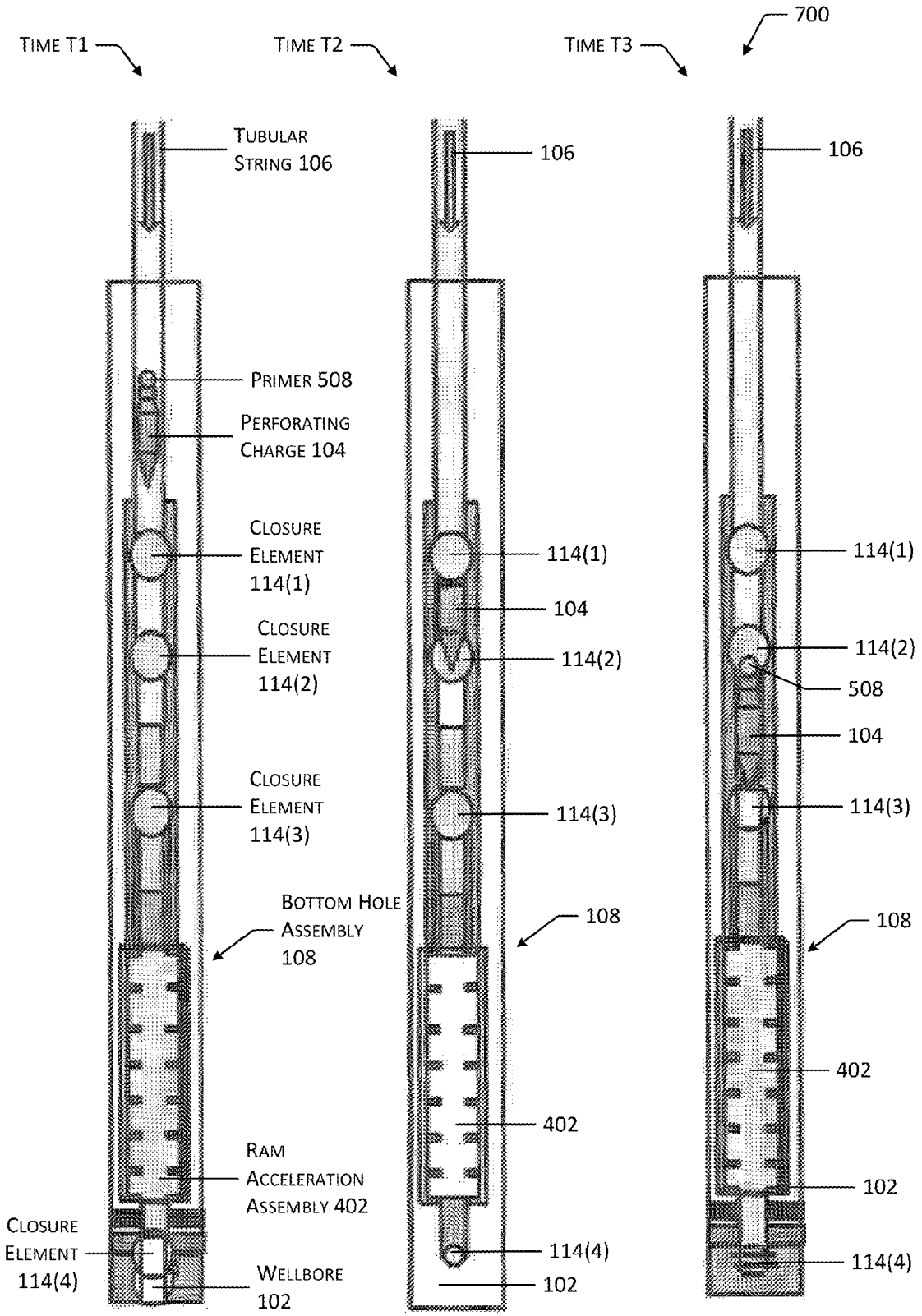
FIG. 7 is a series of diagrams illustrating a first portion of a process for forming a wellbore using perforating charges.

FIG. 7 is a series of diagrams 700 illustrating a first portion of a process for forming a wellbore 102 using perforating charges 104. Specifically, FIG. 7 includes diagrams 700 illustrating a system at a first time T1, a second time T2 subsequent to the first time T1, and a third time T3 subsequent to the second time T2. At the first time T1, drilling fluid 110 in a tubular string 106 may move a perforating charge 104 toward a bottom hole assembly 108. In some implementations, the tubular string 106 may include drill pipe. The bottom hole assembly 108 may include a tubular element positioned above a ram acceleration assembly 402 which, as described with regard to FIG. 4, may include baffles 406 in some implementations. FIG. 7 depicts the bottom hole assembly 108 including three closure elements 114 above the ram acceleration assembly 402, which may be operated sequentially to control the passage of a perforating charge 104 into different portions of the bottom hole assembly 108. A fourth closure element 114(4) is also shown at the lower end of the bottom hole assembly 108, which may be opened to permit a perforating charge 104 to exit the bottom hole assembly 108 and impact the bottom of the wellbore 102. In some implementations, an end cap may be positioned at or near the lower end of the bottom hole assembly 108.

At the second time T2, FIG. 7 illustrates movement of the perforating charge 104 into an upper portion of the bottom hole assembly 108, subsequent to opening of the first closure element 114(1). Movement of drilling fluid 110 in the tubular string 106 and bottom hole assembly 108 in and around the perforating charge 104 may push the perforating charge 104 through the first closure element 114(1) into the bottom hole assembly 108. As described with regard to FIGS. 1 and 3, in some implementations, at least a portion of the drilling fluid 110 may be diverted away from the interior of the bottom hole assembly 108, such as through use of one or more ports 304. The first closure element 114(1) may then be closed to isolate the perforating charge 104 from the tubular string 106 and prevent passage of additional perforating charges 104 or other materials beyond the first closure element 114(1). At the third time T3, FIG. 7 illustrates movement of the perforating charge 104 into a middle portion of the bottom hole assembly 108, subsequent to opening of the second closure element 114(2). After passage of the perforating charge 104, the second closure element 114(2) may be closed. The third closure element 114(3) may then be opened, to permit passage of the perforating charge 104 into a lower portion of the bottom hole assembly 108.

Figure 8:
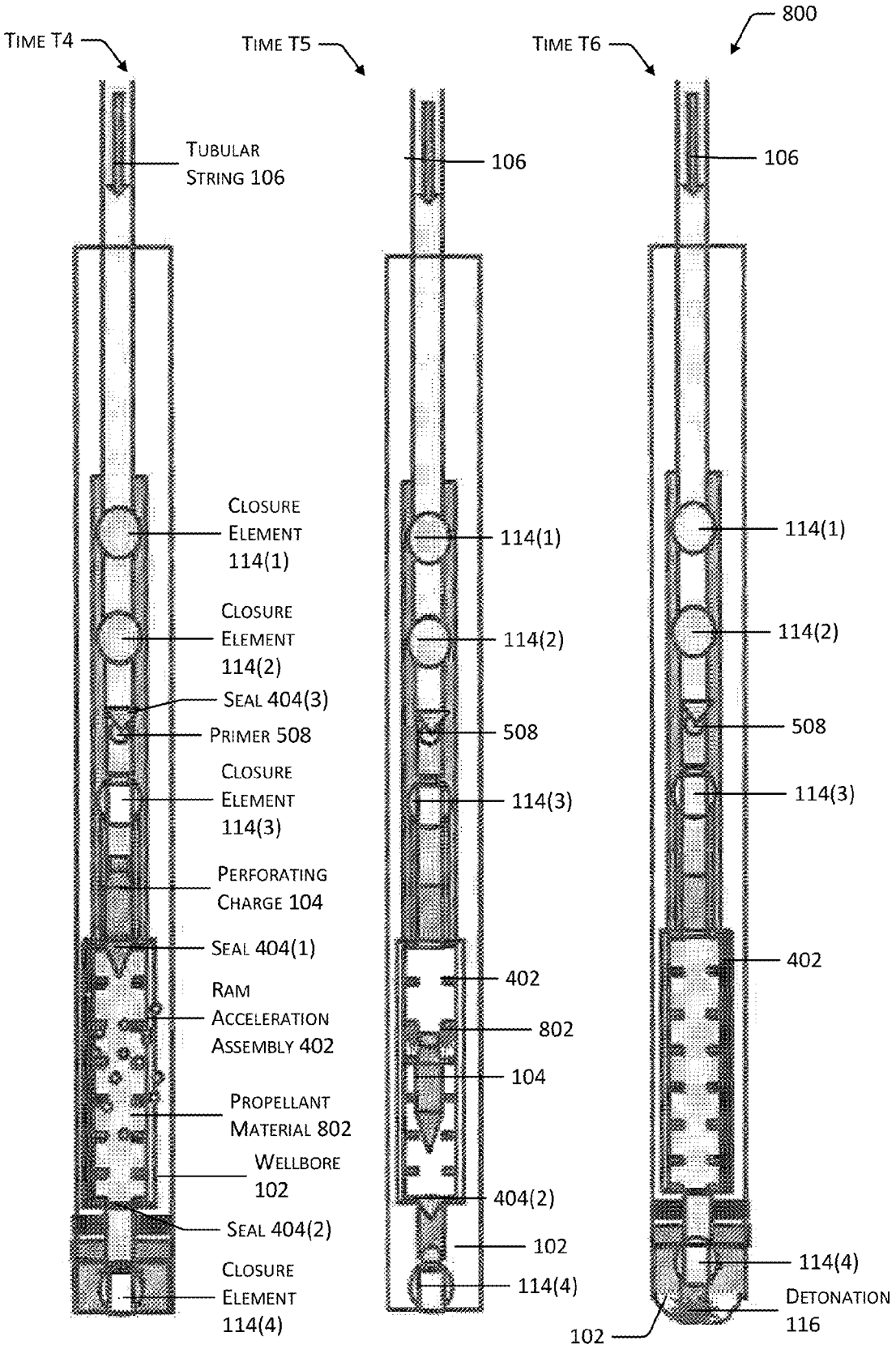
FIG. 8 is a series of diagrams illustrating a second portion of a process for forming a wellbore using perforating charges.

FIG. 8 is a series of diagrams 800 illustrating a second portion of a process for forming a wellbore 102 using perforating charges 104. Specifically, FIG. 8 includes diagrams illustrating the system 700 of FIG. 7 at a fourth time T4 subsequent to the third time T3, a fifth time T5 subsequent to the fourth time T4, and a sixth time T6 subsequent to the fifth time T5. At the fourth time T4, FIG. 8 illustrates movement of the perforating charge 104 into a lower portion of the bottom hole assembly 108. Primer 508 associated with an upper end of the perforating charge 104 may be used to prepare a detonation or other type of reaction for initiation in the middle portion of the bottom hole assembly 108. A first seal 404(1) at the upper end of the ram acceleration assembly 402 and a second seal 404(2) at the lower end of the ram acceleration assembly 402 may be loaded to enable propellant material 802 to be provided into the ram acceleration assembly 402. In some implementations, isolation of the ram acceleration assembly 402 may enable the propellant material 802 to be pressurized independent of the pressure of the wellbore 102, tubular string 106, or other portions of the bottom hole assembly 108. For example, the propellant material 802 may include one or more pressurized gasses. A third seal 404(3) may be positioned above the primer 508 to contain and direct force from the detonation 116 or other reaction in a downhole direction to propel the perforating charge 104.

At the fifth time T5, FIG. 8 illustrates motion of the perforating charge 104 after initiation of the detonation reaction and actuation of at least a portion of the propellant material 802 within the ram acceleration assembly 402. The propellant materials 802, in conjunction with the position of the perforating charge 104 relative to the baffles 406 or other features of the ram acceleration assembly 402 may facilitate acceleration of the perforating charge 104. At the sixth time T6, FIG. 8 illustrates the perforating charge 104 having passed through the open fourth closure element 114(4) to impact the bottom of the wellbore 102, where a detonation 116 may displace at least a portion of the geologic material located at the bottom of the wellbore 102. Subsequent to the exit of the perforating charge 104 from the bottom hole assembly 108, high speed gasses may refill the ram acceleration assembly 402 at well pressure. Subsequent perforating charges 104 may be moved into the bottom hole assembly 108 in a similar manner.

Energy for the detonation 116 of the perforating charge 104 may be obtained using one or more explosive compounds, such as Research and Development Formula X (RDX), octogen (e.g., cyclotetramethylene-tetranitramine, known as HMX), PYX explosive (e.g., 2,6-Bis(picrylamino)-3,5-dinitropyridine), hexanitrostilbene (HNS or JD-X), and so forth. In some implementations, hydrocarbons or other sources of energy, such as gelled diesel fuel or fertilizer, may be provided into a downhole environment by encapsulating such materials within drilling fluid 110. In some implementations, materials provided into the downhole environment may be mixed in situ (e.g., into a cake layer) and detonated.

Figure 9:
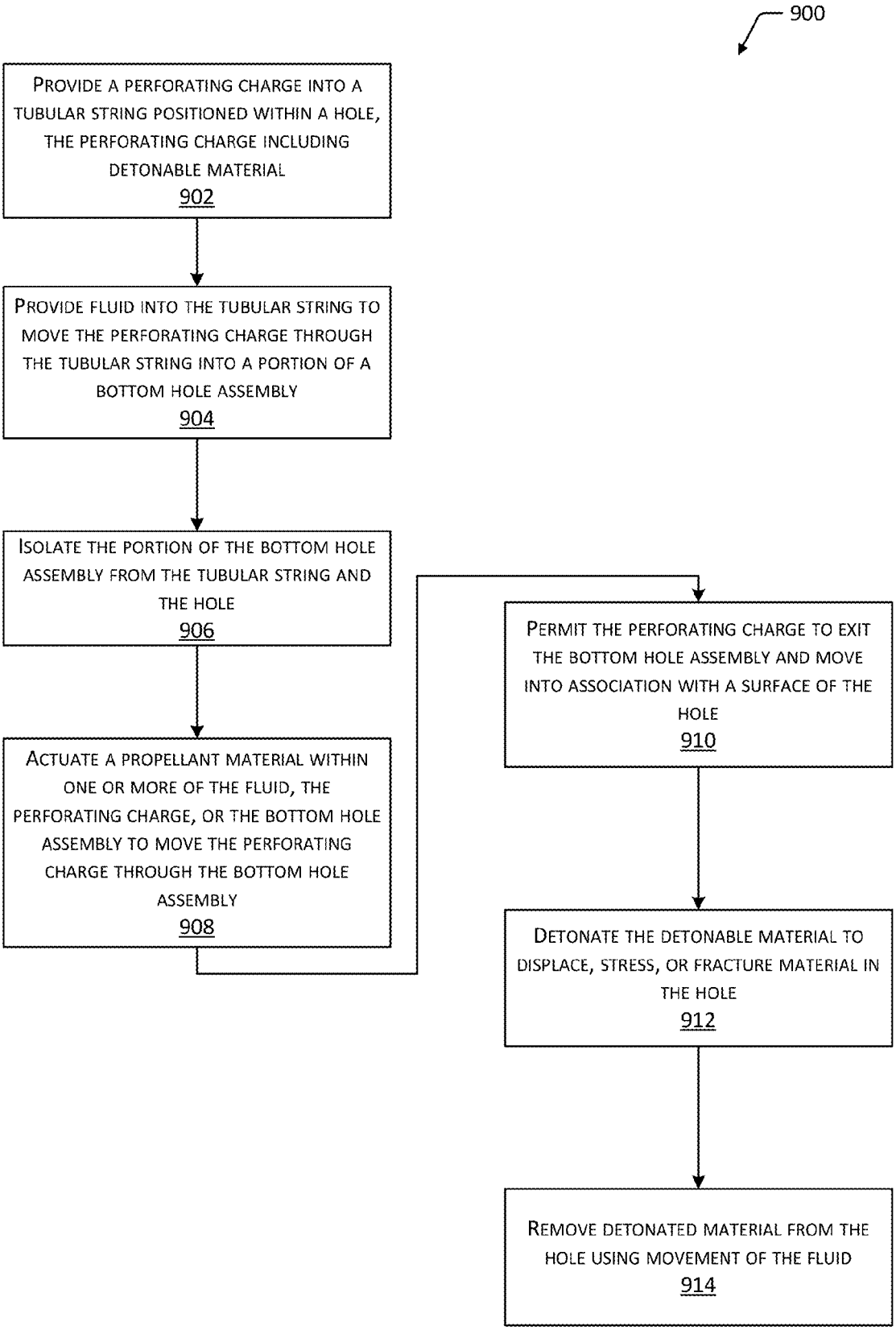
FIG. 9 is a flow diagram illustrating a process for providing perforating charges into association with a surface of a hole.

FIG. 9 is a flow diagram 900 illustrating a process for providing perforating charges 104 into association with a surface of a hole, such as a wellbore 102 or other type of geological or manmade feature. Association between the perforating charges 104 and the surface of the hole may include impact or contact between a perforating charge 104 and the surface of the hole, or proximity between the perforating charge 104 and the surface without contact. Block 902 provides a perforating charge 104 into a tubular string 106 positioned within the hole, the perorating charge 104 including a detonable material. For example, at least a portion of the body of the perforating charge 104 may include an explosive material, a material that generates a force, pressure, or shock wave when actuated, and so forth.

Block 904 provides fluid, such as drilling fluid 110, into the tubular string 106 to move the perforating charge 104 through the tubular string 106 into a portion of a bottom hole assembly 108. As described with regard to FIG. 5, in some implementations, the perforating charge 104 may include an obturator 506 or other portion that may be shaped to receive force from the fluid to facilitate movement of the perforating charge 104 through the tubular string 106. In some implementations, at least a portion of the fluid may flow past or around the perforating charge 104. For example, drilling fluid 110 circulated through the tubular string 106 may both move the perforating charge 104 and perform other functions within a wellbore 102, such as pressure control, circulation of cuttings, cooling and lubrication of a drill bit or other components, and so forth.

Block 906 isolates the portion of the bottom hole assembly 108 containing the perforating charge 104 from the tubular string 106 and the hole. For example, one or more seals 404, such as cup-type seals 404, closure elements 114, such as ball valves or end caps, or other types of separation mechanisms may be used to at least partially enclose the portion of the bottom hole assembly 108. Continuing the example, the bottom hole assembly 108 may include a ram acceleration assembly 402 that may be sealed to enable pressurization of one or more propellant materials 802, such as gasses, contained therein.

Block 908 actuates a propellant material 802 within one or more of the fluid, the perforating charge 104, or the bottom hole assembly 108 to move the perforating charge 104 through the bottom hole assembly 108. In some implementations, propellant material 802 may be entrained within the fluid and provided into the portion of the bottom hole assembly 108 concurrent with the perforating charge 104. In other implementations, the perforating charge 104 may include propellant material 802 in the body thereof. In still other implementations, propellant material 802 may be generated in situ within the bottom hole assembly 108 or another portion of the tubular string 106, such as through use of gas or fluid generating components contained in the perforating charge 104, fluid, or bottom hole assembly 108. In yet another implementation, propellant material 802 may be positioned in the bottom hole assembly 108 prior to entry of the perforating charge 104 or may be separately flowed to the bottom hole assembly 108 using one or more fluid conduits. Actuation of the propellant material 802 may include pressurization or combustion of the propellant material 802. In some implementations, interactions between the perforating charge 104, the propellant material 802, and the interior of a ram acceleration assembly 402 may generate a ram effect that accelerates the perforating charge 104 through the bottom hole assembly 108.

Block 910 permits the perforating charge 104 to exit the bottom hole assembly 108 and move into association with a surface of the hole. For example, a closure element 114, such as a ball valve, may be opened to permit the perforating charge 104 to pass through a lower orifice of the bottom hole assembly 108. In other implementations, the closure element 114 may include an endcap or floating ball. In still other implementations, pressure within the bottom hole assembly 108 may prevent the ingress of material from the hole into the bottom hole assembly 108, and use of a closure element 114 may be omitted. In some implementations, the perforating charge 104 may include a front endcap 502 or other structure shaped to at least partially penetrate into the surface of the hole.

Block 912 detonates the detonable material in the perforating charge 104 to displace, stress, or fracture material in the hole. For example, the perforating charge 104 may include an explosive material that detonates upon impact with the surface of the hole, or upon a separate triggering event. In some implementations, detonation of the perforating charge may extend at least one dimension of the hole.

Block 914 removes detonated material from the hole using movement of the fluid. For example, detonation of the perforating charge 104 may fill at least a portion of the hole with material removed from the surface of the hole and portions of the detonated perforating charge 104. Movement of the fluid in an uphole direction may move such materials away from the surface of the hole. For example, circulation of drilling fluid 110 in a downhole direction through a tubular string 106, then in an uphole direction through an annulus 112 may remove the detonated material from a wellbore 102.

The following clauses provide additional description of various embodiments and structures:

1. A method comprising:

providing a detonable material into a tubular string positioned within a wellbore;

moving the detonable material through the tubular string and into association with a surface of the wellbore; and detonating the detonable material to one or more of displace, stress, or fracture geologic material of the surface of the wellbore.

2. The method of clause 1, wherein the detonable material is contained within a charge assembly including:

a first end;

a second end opposite the first end;

an endcap at the first end having a shape configured to at least partially penetrate into the surface of the wellbore; and an obturator at the second end having a shape configured to receive a force from at least one material within the tubular string to accelerate the charge assembly.

3. The method of one or more of clauses 1 or 2, further comprising providing a drilling fluid into the tubular string, wherein the drilling fluid moves the detonable material through the tubular string.

4. The method of clause 3, further comprising moving displaced geologic material and detonated detonable material away from the surface of the wellbore using movement of the drilling fluid.

5. The method of clause one or more of clauses 3 or 4, further comprising:

providing a plurality of communication components into the drilling fluid; and providing one or more communication signals from a first device associated with the tubular string to a second device associated with the tubular string, wherein the one or more communication signals are transmitted via the plurality of communication components.

6. The method of one or more of clauses 1 through 5, further comprising:

moving the detonable material through the tubular string to an interior of a bottom hole assembly;

isolating the bottom hole assembly from the tubular string; and actuating one or more propellant materials in the bottom hole assembly to move the detonable material through the bottom hole assembly and into association with the surface of the wellbore.

7. The method of clause 6, further comprising:

entraining at least a portion of the one or more propellant materials within drilling fluid; and providing the drilling fluid to the bottom hole assembly through the tubular string.

8. The method of one or more of clauses 1 through 7, further comprising:

providing a drilling fluid into the tubular string, wherein the drilling fluid moves the detonable material through the tubular string;

moving the detonable material through the tubular string to an interior of a bottom hole assembly;

isolating the bottom hole assembly from the tubular string; and diverting at least a portion of the drilling fluid through a fluid path in the bottom hole assembly, wherein the fluid path is located outside of the interior.

9. The method of one or more of clauses 1 through 8, further comprising moving the detonable material past an electrical generator associated with a wall of the wellbore, wherein the moving of the detonable material causes the electrical generator to generate power.

10. A system comprising:

a tubular string positioned within a hole, the tubular string having a first end and a second end opposite the first end;

a bottom hole assembly engaged with the second end;

a fluid source configured to move fluid through the tubular string toward the second end;

a perforating charge moved by the fluid through the tubular string toward the second end, wherein the fluid moves the perforating charge into the bottom hole assembly; and a propellant material, wherein actuation of the propellant material moves the perforating charge through the bottom hole assembly into association with a surface of the hole.

11. The system of clause 10, wherein the propellant material is contained within the perforating charge.

12. The system of one or more of clauses 10 or 11, wherein the propellant material is entrained within the fluid in the tubular string.

13. The system of one or more of clauses 10 through 12, wherein the perforating charge includes:

an endcap at a first end, the endcap shaped to at least partially penetrate the surface of the hole; and an obturator at a second end opposite the first end, the obturator shaped to receive a force from one or more of the fluid or the propellant material.

14. The system of one or more of clauses 10 through 13, wherein the bottom hole assembly includes a ram acceleration assembly having an interior with one or more of a plurality of baffles or a plurality of rails, wherein an interaction between the perforating charge, the propellant material, and the one or more of the plurality of baffles or the plurality of rails accelerates the perforating charge through the bottom hole assembly.

15. The system of clause 14, wherein the bottom hole assembly further includes a tubular member having an inner bore in communication with the ram acceleration assembly and a plurality of closure elements for controlling access to one or more of the inner bore or the ram acceleration assembly.

16. The system of one or more of clauses 14 or 15, wherein the ram acceleration assembly further comprises a first seal proximate to a first end and a second seal proximate to a second end, the first seal and the second seal configured to isolate the ram acceleration assembly from the tubular string for pressurizing of the propellant material.

17. A method comprising:

providing a perforating charge into a tubular string, wherein the tubular string is positioned within a hole;

providing a fluid into the tubular string to move the perforating charge through the tubular string into a portion of a bottom hole assembly; and actuating a propellant material to move the perforating charge through the bottom hole assembly and into association with a surface of the hole.

18. The method of clause 17, wherein the portion of the bottom hole assembly includes a ram acceleration assembly, the method further comprising pressurizing the propellant material within the ram acceleration assembly, wherein an interaction between the perforating charge, the propellant material, and the ram acceleration assembly accelerates the perforating charge through the bottom hole assembly.

19. The method of one or more of clauses 17 or 18, further comprising:

providing a plurality of communication components into the fluid; and communicating one or more signals between a first device proximate to a first end of the tubular string and a second device proximate to a second end of the tubular string by transmitting the one or more signals via the plurality of communication components.

20. The method of one or more of clauses 17 through 19, further comprising:

providing the propellant material into the fluid; and transporting the propellant material to the bottom hole assembly using movement of the fluid.

Those having ordinary skill in the art will readily recognize that certain steps or operations illustrated in the figures above can be eliminated, combined, subdivided, executed in parallel, or taken in an alternate order. Moreover, the methods described above may be implemented using one or more software programs for a computer system and are encoded in a computer-readable storage medium as instructions executable on one or more hardware processors. Separate instances of these programs can be executed on or distributed across separate computer systems.

Although certain steps have been described as being performed by certain devices, processes, or entities, this need not be the case, and a variety of alternative implementations will be understood by those having ordinary skill in the art.

Additionally, those having ordinary skill in the art readily recognize that the techniques described above can be utilized in a variety of devices, environments, and situations. Although the present disclosure is written with respect to specific embodiments and implementations, various changes and modifications may be suggested to one skilled in the art, and it is intended that the present disclosure encompass such changes and modifications that fall within the scope of the appended claims.

What is claimed is:

1. A method comprising:

providing a detonable material into a tubular string positioned within a wellbore;

providing a drilling fluid into the tubular string to move the detonable material through the tubular string and into an inner bore of a bottom hole assembly;

isolating the inner bore of the bottom hole assembly from the tubular string, wherein the isolating of the inner bore prevents entry of the drilling fluid into the inner bore;

diverting at least a portion of the drilling fluid through one or more of a port or a fluid pathway in one or more of the tubular string or the bottom hole assembly to communicate the drilling fluid with an annulus external to the tubular string;

actuating one or more propellant materials in the inner bore of the bottom hole assembly to move the detonable material through the inner bore of the bottom hole assembly and into association with a surface of the wellbore; and detonating the detonable material to one or more of displace, stress, or fracture geologic material of the surface of the wellbore.

2. The method of claim 1, wherein the detonable material is contained within a charge assembly including:

a first end;

a second end opposite the first end;

an endcap at the first end having a shape configured to at least partially penetrate into the surface of the wellbore; and an obturator at the second end having a shape configured to receive a force from at least one material within the tubular string to accelerate the charge assembly.

3. The method of claim 1, further comprising moving displaced geologic material and detonated detonable material away from the surface of the wellbore using movement of the drilling fluid.

4. The method of claim 1, further comprising:

providing a plurality of communication components into the drilling fluid; and providing one or more communication signals from a first device associated with the tubular string to a second device associated with the tubular string, wherein the one or more communication signals are transmitted via the plurality of communication components.

5. The method of claim 4, wherein the plurality of communication components includes one or more of at least one material or at least one device suspended within the drilling fluid.

6. The method of claim 1, further comprising:

entraining at least a portion of the one or more propellant materials within the drilling fluid; and providing the drilling fluid to the bottom hole assembly through the tubular string.

7. The method of claim 1, further comprising moving the detonable material past an electrical generator associated with a wall of the wellbore, wherein the moving of the detonable material causes the electrical generator to generate power.

8. The method of claim 1, further comprising actuating a first closure element positioned between the tubular string and the inner bore of the bottom hole assembly to isolate the inner bore from the tubular string.

9. The method of claim 8, further comprising actuating a second closure element positioned between the inner bore and the wellbore to permit passage of the detonable material to the surface of the wellbore.

10. A system comprising:

a tubular string positioned within a hole, the tubular string having a first end and a second end opposite the first end;

a bottom hole assembly engaged with the second end, wherein the bottom hole assembly has an inner bore;

a fluid source configured to move fluid through the tubular string toward the second end;

a perforating charge moved by the fluid through the tubular string toward the second end, wherein the fluid moves the perforating charge into the inner bore of the bottom hole assembly;

a closure element to isolate the inner bore of the bottom hole assembly from the tubular string to prevent entry of at least a portion of the fluid into the inner bore and divert the at least a portion of the fluid to an exterior of the bottom hole assembly; and a propellant material in the inner bore, wherein actuation of the propellant material moves the perforating charge through the bottom hole assembly into association with a surface of the hole.

11. The system of claim 10, wherein the propellant material is contained within the perforating charge.

12. The system of claim 10, wherein the propellant material is entrained within the fluid in the tubular string and movement of the fluid moves the propellant material into the inner bore.

13. The system of claim 10, wherein the perforating charge includes:

an endcap at a first end of the perforating charge, wherein the endcap is shaped to at least partially penetrate the surface of the hole; and an obturator at a second end of the perforating charge opposite the first end of the perforating charge, wherein the obturator is shaped to receive a force from one or more of the fluid or the propellant material.

14. The system of claim 10, wherein the bottom hole assembly includes a ram acceleration assembly having an interior with one or more of a plurality of baffles or a plurality of rails, and an interaction between the perforating charge, the propellant material, and the one or more of the plurality of baffles or the plurality of rails accelerates the perforating charge through the bottom hole assembly.

15. The system of claim 14, wherein the inner bore is in communication with the ram acceleration assembly, and the bottom hole assembly further includes a plurality of closure elements for controlling access to one or more of the inner bore or the ram acceleration assembly.

16. The system of claim 14, wherein the ram acceleration assembly further comprises a first seal proximate to the first end and a second seal proximate to the second end, and the first seal and the second seal isolate the ram acceleration assembly from the tubular string for pressurizing of the propellant material.

17. A method comprising:

providing a perforating charge into a tubular string, wherein the tubular string is positioned within a hole;

providing a fluid into the tubular string to move the perforating charge through the tubular string into a portion of a bottom hole assembly;

isolating the portion of the bottom hole assembly from the tubular string to prevent entry of at least a portion of the fluid into the portion of the bottom hole assembly; and actuating a propellant material in the portion of the bottom hole assembly to move the perforating charge through the bottom hole assembly and into association with a surface of the hole.

18. The method of claim 17, wherein the portion of the bottom hole assembly includes a ram acceleration assembly, the method further comprising pressurizing the propellant material within the ram acceleration assembly, and an interaction between the perforating charge, the propellant material, and the ram acceleration assembly accelerates the perforating charge through the bottom hole assembly.

19. The method of claim 17, further comprising:

providing a plurality of communication components into the fluid; and communicating one or more signals between a first device proximate to a first end of the tubular string and a second device proximate to a second end of the tubular string by transmitting the one or more signals via the plurality of communication components.

20. The method of claim 17, further comprising:

providing the propellant material into the fluid; and transporting the propellant material to the bottom hole assembly using movement of the fluid.

* * * * *